US005408162A

United States Patent [19]

Williams

[11] Patent Number: 5,408,162

[45] Date of Patent: Apr. 18, 1995

[54] FLUORESCENT LAMP POWER SUPPLY AND CONTROL UNIT

[75] Inventor: James M. Williams, Palo Alto, Calif.

[73] Assignee: Linear Technology Corporation, Milpitas, Calif.

[21] Appl. No.: 43,152

[22] Filed: Mar. 31, 1993

Related U.S. Application Data

[63] Continuation of Ser. No. 857,734, Mar. 26, 1992, abandoned.

[51] Int. Cl.[6] ..... H05B 41/36

[52] U.S. Cl. ..... 315/224; 315/307; 315/DIG. 7; 315/DIG. 5

[58] Field of Search ..... 315/224, DIG. 7, DIG. 5, 315/219, 307, 242, 243, 310

[56] References Cited

U.S. PATENT DOCUMENTS

| | | | |
|---|---|---|---|
| 4,277,728 | 7/1981 | Stevens | 315/DIG. 7 |
| 4,723,098 | 2/1988 | Grubbs | 315/DIG. 7 |
| 4,952,849 | 8/1990 | Fellows et al. | 315/307 |
| 5,068,576 | 11/1991 | Hu et al. | 315/307 |
| 5,111,118 | 5/1992 | Fellows et al. | 315/307 |

OTHER PUBLICATIONS

"*RCA Designer's Handbook: Solid-State Power Circuits*", Technical Series SP-52, pp. 300-338 and 409-429, published by RCA Corporation, Somerville, New Jersey in 1971.

"*1992 Catalog of Sumida Electric Co., Ltd.*", pp. 1-5 and 25, published by Sumida Electric Co., Ltd., Japan in 1991.

*Primary Examiner*—Georgia Y. Epps
*Assistant Examiner*—Tan Dinh
*Attorney, Agent, or Firm*—Fish & Neave; Laurence S. Rogers; Robert W. Morris

[57] ABSTRACT

A power supply and control circuit is provided for driving a fluorescent lamp from a low voltage DC power source such as a battery. A DC-to-AC inverter coupled to a switching regulator converts low DC voltage into a higher AC voltage for driving the fluorescent lamp. The lamp is included in a feedback loop which includes a circuit for producing a feedback signal indicative of the magnitude of current conducted by the lamp. The feedback signal is applied to the switching regulator to produce in the lamp a regulated current and, hence, a regulated lamp intensity. The magnitude of the lamp current can be adjusted to enable the intensity of the fluorescent lamp to be smoothly and continuously varied (without "dead-spots" or "pop-on") over a chosen intensity range, including if desired, from substantially full OFF to full ON. A method for driving a fluorescent lamp from a low voltage DC power source is also provided.

44 Claims, 6 Drawing Sheets

FLUORESCENT LAMP POWER SUPPLY AND CONTROL UNIT

This is a continuation of application Ser. No. 07/857,734, filed Mar. 26, 1992 and now abandoned, entitled FLUORESCENT LAMP POWER SUPPLY AND CONTROL CIRCUIT in the name of James M. Williams.

BACKGROUND OF THE INVENTION

This invention relates to fluorescent lamp power supplies. More particularly, this invention relates to a fluorescent lamp power supply and control circuit which enables the lamp to be regulated to shine at a substantially constant intensity as the lamp ages or the power supply voltage fluctuates, and which also enables lamp intensity to be adjusted continuously and smoothly over a chosen intensity range including, if desired, substantially from full OFF to full ON.

Fluorescent lamps are finding increased use in systems requiring an efficient and broad-area source of visible light. For example, portable computers such as lap-top and notebook computers use fluorescent lamps to back-light or side-light liquid crystal displays to improve the contrast or brightness of the display. Fluorescent lamps have also been used to illuminate automobile dashboards, and are being considered for use with battery-driven backup emergency EXIT lighting systems in commercial buildings.

Fluorescent lamps find use in these and other low-voltage applications because they are more efficient, and emit light over a broader area, than incandescent lamps. Particularly in applications requiring long battery life, such as in the case of portable computers, the increased efficiency of fluorescent lamps translates into extended battery life or reduced battery weight, or both.

In low-voltage applications such as those discussed above, a power supply and control circuit must be used to operate the fluorescent lamp. This is because power typically is provided by a 3–20 volt DC source, while fluorescent lamps generally require 100 volts AC or more to efficiently operate. Accordingly, a power supply and control circuit is needed to convert the available low DC voltage into the necessary high AC voltage.

Previous known fluorescent lamp power supply and control circuits have suffered from one or more drawbacks. Some circuits, for example, cannot smoothly and continuously vary the intensity of a fluorescent lamp from substantially full OFF to full ON. These circuits have low intensity "dead-spots" which cause the fluorescent lamp to either abruptly and prematurely turn OFF when the lamp's intensity is reduced toward zero, or to abruptly "pop-on" when the intensity is increased from zero. Other known circuits avoid this problem simply by limiting the range over which the lamp's intensity can be varied. These circuits do not allow adjustment of intensity over the range of full OFF to full ON.

A further disadvantage of some previous known fluorescent lamp power supply and control circuits is that lamp intensity may change as the lamp ages or as the power supply voltage fluctuates.

Yet another disadvantage of some previous known fluorescent lamp power supply and control circuits is that they are inefficient. This inefficiency necessitates the use of larger and heavier batteries or results in decreased battery life. Neither is desirable in portable computer applications.

A further disadvantage of some known fluorescent lamp power supply and control circuits is that they can be a source of radio frequency emission. Such emission can cause undesirable electromagnetic interference with nearby devices, and can degrade overall circuit efficiency.

In view of the foregoing, it would therefore be desireable to provide a power supply and control circuit for a fluorescent lamp which enables the lamp's intensity to be regulated so that it shines at a substantially constant intensity as the lamp ages or as the power supply voltage fluctuates.

It would also be desirable to provide a power supply and control circuit for a fluorescent lamp which enables the lamp's intensity to be continuously and smoothly adjusted by a user over a chosen range of intensities.

It would further be desirable to provide a power supply and control circuit for a fluorescent lamp which enables the lamp's intensity to be continuously and smoothly adjusted by a user from substantially full OFF to full ON.

It would additionally be desirable to be able to provide such a fluorescent lamp power supply and control circuit which is efficient, and which produces a minimum of spurious radio frequency emissions.

SUMMARY OF THE INVENTION

It is an object of this invention to provide a fluorescent lamp power supply and control circuit which enables the intensity of the lamp to be regulated so that the lamp shines at a substantially constant intensity as the lamp ages or as the power supply voltage fluctuates.

It is also an object of this invention to provide a fluorescent lamp power supply and control circuit which enables the intensity of the lamp to be adjusted continuously and smoothly over a chosen range of intensities.

It is a further object of this invention to provide a fluorescent lamp power supply and control circuit which enables the intensity of the lamp to be adjusted continuously and smoothly substantially from full OFF to full ON.

It is an additional object of this invention to provide such a fluorescent lamp power supply and control circuit which is efficient so as to reduce power supply requirements and also extend battery lifetime.

It is yet an additional object of this invention to provide such a fluorescent lamp power supply and control circuit which emits a minimum of radio frequency interference.

In accordance with the present invention, there is provided a power supply and control circuit and method for driving a fluorescent lamp from a low voltage D.C. source. A regulator circuit, powered by the D.C. source, is coupled to a DC-to-AC invertor the output of which, in turn, is coupled to a first terminal of the lamp. The invertor converts, under control of the regulator circuit, the low-voltage DC supplied by the DC power source to high-voltage sinusoidal AC sufficient to operate the fluorescent lamp. A second terminal of the lamp is coupled to a circuit which senses and produces a signal indicative of the magnitude of current conducted by the lamp. This current sense signal is fed back to the regulator in such manner so as to regulate the current supplied to the lamp by the invertor. As a result, the current conducted by the lamp—and, hence, the intensity of the light emitted by the lamp—are regulated as a function of the feedback signal. A means is also provided to enable the lamp's current to be varied by a user, thus allowing lamp intensity to be smoothly and continuously adjusted (without dead-spots or pop on) over a chosen range of intensities. This range of intensity variation can include, if desired, from substantially full OFF to full ON. The combination of a switching regulator and an invertor for producing substantially sinusoidal AC results in a highly efficient circuit which emits a minimum of spurious RF radiation.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE INVENTION

Figure 1:
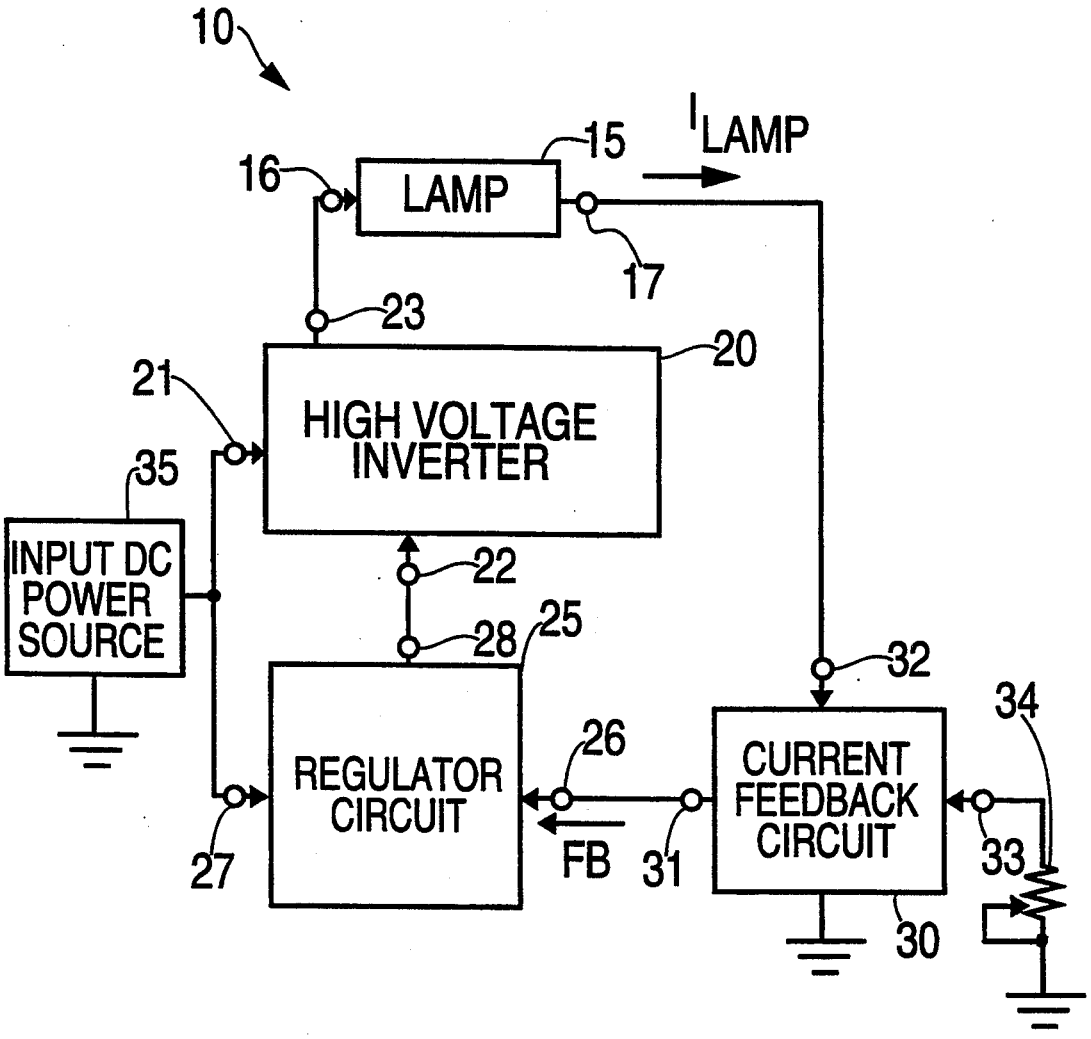
FIG. 1 is a block diagram of the fluorescent lamp power supply and control circuit of the present invention.

FIG. 1 is a block diagram of the fluorescent lamp power supply and control circuit of the present invention.

As shown in FIG. 1, input DC power source 35 provides power for the circuit. Power source 35 can be any source of DC power. For example, in the case of a portable computer such as a lap-top or notebook computer, power source 35 can be a nickel-cadmium or nickel-hydride battery providing 3–5 volts. Or, if the circuit of the present invention is used with an automobile dashboard, power source 35 can be a 12–14 volt automobile battery and power supply. Similarly, fluorescent lamp 15 can be any type of fluorescent lamp. For example, in the case of lighting a display in a portable computer, fluorescent lamp 15 can be a cold- or hot-cathode fluorescent lamp.

Input DC power source 35 supplies low DC voltage to regulator circuit 25 (at terminal 27) and high-voltage invertor 20 (at terminal 21). Regulator circuit 25 can be a linear or switching regulator but, for maximum efficiency, a switching regulator is preferred. The output of regulator circuit 25 is taken from terminal 28. Terminal 26 is a feedback terminal adapted to receive a feedback signal by which the output of regulator 25 can be controlled. If regulator 25 is a switching regulator, the feedback terminal causes the duty cycle of the regulator's switching transistor to be controlled to regulate the output.

High-voltage invertor 20 receives a low voltage DC input at terminal 21 from input DC power source 35, and produces at output terminal 23 an AC voltage sufficient in magnitude to drive fluorescent lamp 15. Typically, the AC voltage produced by invertor circuit 20 is 100 volts or more. Terminal 22 is a control terminal coupled to receive from terminal 28 of regulator circuit 25 a control signal. The control signal regulates the output of high-voltage invertor 20, in a manner as described below. The output of invertor 20 is coupled to lamp 15 at the lamp's terminal 16 (typically, through a conventional ballast capacitor not shown). For maximum efficiency of operation, and to minimize the emission of radio frequency interference, invertor circuit 20 preferably converts DC power to sinusoidal AC power.

Also in FIG. 1 is a current feedback circuit 30, shown coupled at terminal 32 to terminal 17 of lamp 15. Feedback circuit 30 functions to produce, at terminal 31, a feedback signal FB indicative of the magnitude of current $I_{LAMP}$ conducted by fluorescent lamp 15. Many different types of current feedback circuits can be used for circuit 30. Preferably, however, circuit 30 includes a current sense impedance coupled between terminal 32 and ground, with signal FB at terminal 31 being a voltage developed across that impedance which is proportional to the magnitude of $I_{LAMP}$. Also coupled between terminal 33 of current feedback circuit 30 and ground is a variable resistor 34. As discussed below, variable resistor 34 can be used to adjust the magnitude of feedback signal FB and, hence, the loop gain of the circuit. As a result, the intensity of fluorescent lamp 15 can be adjusted with control 34 smoothly and continuously (without dead-spots or pop-on) throughout a chosen range of intensities, including if desired, from substantially full OFF to full ON.

The circuit of FIG. 1 operates as follows. High voltage invertor 20, in combination with regulator circuit 25, delivers high voltage AC power to fluorescent lamp 15. The current through fluorescent lamp 15, $I_{LAMP}$, is sensed by current feedback circuit 30. Circuit 30 produces a negative feedback signal FB proportional to the magnitude of $I_{LAMP}$. By coupling signal FB back to a feedback terminal of regulator circuit 25, the output of regulator circuit 25 is modulated as a function of the magnitude of $I_{LAMP}$. The output of regulator circuit 25, in turn, controls and modulates the output of invertor 20. As a result, the magnitude of current ($I_{LAMP}$) conducted by fluorescent lamp 15—and, hence, the intensity of light emitted by the lamp—is regulated to a substantially constant value.

By including lamp 15 in a current feedback loop with regulator 25, the lamp's current and light intensity will be regulated and thus will remain substantially constant despite changes in input power, lamp characteristics or environmental factors. Circuit 10 functions to keep the lamp current $I_{LAMP}$ substantially constant, independent of lamp impedance or power supply voltage. Thus, as a lamp's impedance goes up or down as the lamp ages, circuit 10 adjusts to such change as appropriate so as to maintain a regulated constant current and lamp intensity, even though the lamp ages. Circuit 10 similarly adjusts as the power supply voltage fluctuates. These features of the present invention can therefore extend the useful lifetime of a fluorescent lamp in some applications.

The operating current of lamp 15 (and, hence, the intensity of the lamp) can be adjustably controlled by adjusting the feedback gain via variable resistor 34. By varying resistance 34, the magnitude of feedback signal FB applied to regulator 25 is varied. This causes lamp current $I_{LAMP}$ to vary responsively. Because fluorescent lamps have high impedance and are essentially current-driven devices, varying the magnitude of $I_{LAMP}$ results in variation of the lamp 15's intensity. Because it is lamp current that is being directly controlled, variable resistor 34 produces a smooth and continuous adjustment of lamp intensity throughout a chosen range of intensity adjustment, including if desired, from full OFF to full ON, without dead-spots or pop-on.

It will, of course, be appreciated by those skilled in the art that variable resistor 34 is shown for purposes of illustration, and not limitation. Other circuit techniques and configurations could as well be used to provide variable control of the lamp current. For example, similar lamp intensity control action could as well be obtained by adding a signal (not shown) at the feedback point (terminal 26 of regulator circuit 25) to adjust loop gain.

Figure 2:
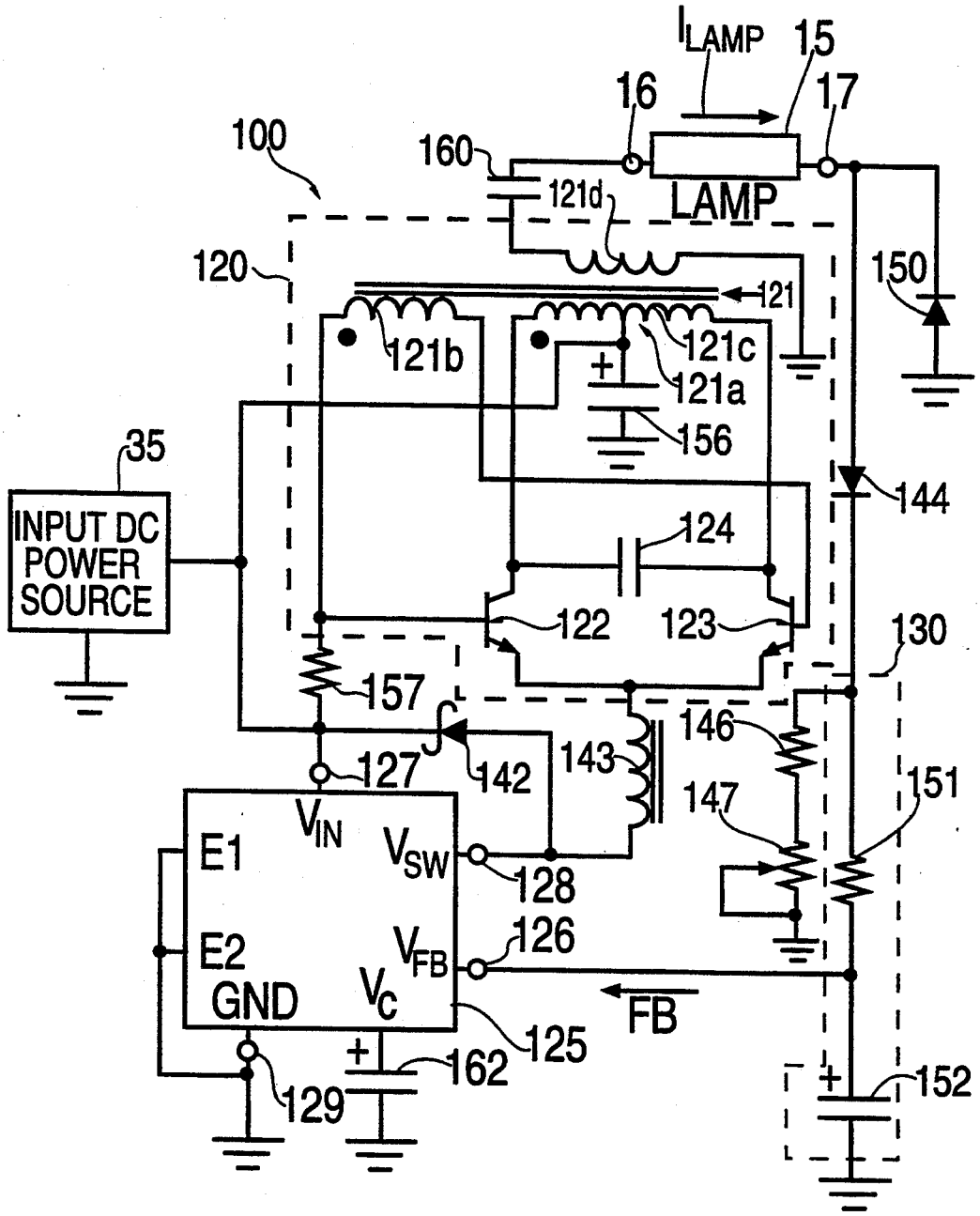
FIG. 2 is a schematic diagram of one exemplary embodiment of the fluorescent lamp power supply and control circuit of FIG. 1.

FIG. 2 is a schematic diagram of one exemplary embodiment of the fluorescent lamp power supply and control circuit of FIG. 1.

As shown in FIG. 2, input DC power source 35 supplies power for fluorescent lamp power supply and control circuit 100. Input DC power source 35, which can be any conventional power source, is used to supply low DC voltage (approximately 3–20 volts) to push-pull high-voltage invertor circuit 120 and current-mode switching regulator circuit 125. Switching regulator 125 can be any of a number of commercially available switching regulators. In the exemplary embodiment of FIG. 2, however, regulator 125 preferably is an LT-1072 integrated circuit switching regulator (available from Linear Technology Corporation of Milpitas, Calif.). When implemented using a LT-1072 switching regulator, regulator circuit 125 includes pin $V_{IN}$ (terminal 127) coupled to power source 35, terminals E1, E2 and GND coupled to ground, frequency compensating terminal $V_c$ coupled through capacitor 162 to ground, switched output pin $V_{SW}$ (terminal 128) and feedback pin $V_{FB}$ (terminal 126).

Invertor circuit 120 is a current-driven high-voltage push-pull invertor which converts the DC power from input DC power source 35 to high-voltage, sinusoidal AC. Invertor 120 is a self-oscillating circuit. Transistors 122 and 123 conduct out of phase and switch each time transformer 121 saturates. During a complete cycle, the magnetic flux density in the core of transformer 121 varies between a saturation value in one direction and a saturation value in the opposite direction. During the cycle time when the magnetic flux density varies from negative minimum to positive maximum, one of transistors 122 and 123 is ON. During the rest of the cycle time (i.e., when the magnetic flux density varies from positive maximum to negative minimum), the other transistor is ON.

Switching of transistors 122 and 123 is initiated when the magnetic flux density in transformer 121 begins to saturate. At that point in time, the inductance of transformer 121 decreases rapidly toward zero, with the result that a quickly rising high collector current flows in the transistor which is ON. This current spike is picked up by transformer bias winding 121*b* of transformer 121. Because the base terminals of transistors 122 and 123 are coupled to bias winding 121*b* of transformer 121, the current spike is fed back into the base of the transistor which produced it. As a result, that transistor drops out of saturation and into cutoff, and the transistor is turned OFF. Accordingly, the current in transformer 121 abruptly drops and the transformer winding voltages then reverse polarity resulting in the turning ON of the other transistor which previously had been OFF. The switching operation is then repeated for this second transistor.

Transistors 122 and 123 alternately switch ON and OFF at a duty cycle of approximately 50 percent. Capacitor 124, coupled between the collectors of transistors 122 and 123, causes what would otherwise be square-wave-like voltage oscillation at the collectors of transistors 122 and 123 to be substantially sinusoidal. Capacitor 124, therefore, operates to reduce RF emissions from the circuit. The frequency of oscillation is primarily set by the combination of the characteristics of transformer 121, capacitor 124 coupled between the collectors of transistors 122 and 123, fluorescent lamp 15, and ballast capacitor 160 coupled to secondary winding 121*d* of transformer 121. Capacitor 156 reduces the high frequency impedance so that transformer center tap 121*a* sees zero impedance at all frequencies.

Transformer 121 steps-up the sinusoidal voltage at the collectors of transistors 122 and 123 to produce, at secondary winding 121*d*, an AC waveform of sufficiently high voltage to drive fluorescent lamp 15 (shown coupled to secondary winding 121*d* through ballast capacitor 160). Ballast capacitor 160 inserts a controlled impedance in series with lamp 15 to minimize sensitivity of the circuit to lamp characteristics and to minimize exposure of fluorescent lamp 15 to DC components.

Invertor 120, in conjunction with current-mode switching regulator circuit 125, thus operates to deliver a controlled AC current at high voltage to terminal 16 of fluorescent lamp 15. Inductor 143, coupled between terminal 128 of regulator 125 and the emitters of transistors 122 and 123, is an energy storage element for switching regulator 125. Inductor 143 also sets the magnitude of the collector currents of transistors 122 and 123 and, hence, the energy through primary winding 121*c* of transformer 121 that is delivered to lamp 15 via secondary winding 121*d*. Schottky diode 142, coupled between input DC power source 35 and switched output pin $V_{SW}$, maintains current flow through inductor 143 during the off cycles of switching regulator circuit 125. Resistor 157 DC biases the respective bases of transistors 122 and 123.

The current delivered to lamp 15 by transformer 121 ($I_{LAMP}$) is regulated to a substantially constant value by a feedback loop including lamp 15, diode 144 and feedback circuit 130. Diode 144, in conjunction with diode 150, half-wave rectifies lamp current $I_{LAMP}$. Diode 150 shunts negative portions of each cycle of $I_{LAMP}$ to ground, and diode 144 passes positive portions of that current (representing one-half the lamp current $I_{LAMP}$) to feedback circuit 130.

Feedback circuit 130 comprises resistor 151 and capacitor 152 coupled in series between the cathode of diode 144 and ground. This produces a voltage, proportional to the magnitude of $I_{LAMP}$, across capacitor 152. This voltage (FB) is presented to the feedback pin (terminal 126) of switching regulator 125. The above connections close the feedback control loop which regulates lamp current. Resistors 146 and 147, connected in parallel with resistor 151 and capacitor 152, allow for DC adjustment in the voltage (FB) which is presented to the feedback pin.

Upon start-up of circuit 100 of FIG. 2, the voltage (FB) on feedback pin 126 of switching regulator circuit 125 is generally below the internal reference voltage of regulator circuit 125 (i.e., 1.23 volts for the LT-1072 discussed above). Thus, full duty cycle modulation at the switched output pin $V_{SW}$ (terminal 128) of regulator circuit 125 occurs. As a result, inductor 143 conducts current which flows from center tap 121*a* of transformer 121, through transistors 122 and 123, into inductor 143. This current is deposited in switched fashion to ground by the regulator's action. This switching action controls lamp 15's average current $I_{LAMP}$, the amount of which is set by the magnitude of the feedback signal FB at the feedback terminal $V_{FB}$ (terminal 126).

The feedback loop forces switching regulator 125 to modulate the output of invertor 120 to whatever value is required to maintain a constant current in lamp 15. The magnitude of that constant current can, however, be varied by variable resistor 147. Because the intensity of lamp 15 is directly related to the magnitude of the current through the lamp, variable resistor 147 thus allows the intensity of lamp 15 to be adjusted smoothly and continuously over a chosen range of intensities, including full OFF to full ON without "dead-spots" or "pop-on" at low lamp intensity.

The circuit of FIG. 2 can be implemented using commercially available components. For example, the circuit can be constructed and operated using the components and values set forth in Table 1, below:

TABLE 1

| | |
|---|---|
| Regulator 125: | LT-1072 (available from Linear Technology Corporation of Milpitas, California) |
| Transformer 121: | SUMIDA-6345-020 (available from SUMIDA ELECTRIC (USA) CO., LTD., of Arlington Heights, Illinois) or COILTRONICS CTX110092-1 (available from Coiltronics Incorporated, of Pompano Beach, Florida) |
| Inductor 143: | 300 microhenrys (COILTRONICS CTX300-4) |
| Diodes 144, 150: | 1N4148 |
| Schottky diode 142: | 1N5818 |
| Transistors 122, 123: | MPS650 |
| Capacitor 124: | low loss 0.02 microfarad (Metalized polycarb WIMA-FKP2 (Germany) preferred) |
| Capacitor 152: | 1 microfarad |
| Capacitor 156: | 10 microfarads |
| Capacitor 160: | 33 picofarads, rated up to 3 kilovolts |
| Capacitor 162: | 2 microfarads |
| Resistor 146: | 562 ohms (1% metal film) |
| Resistor 151: | 10 kohms |
| Resistor 157: | 1 kohm |
| Variable resistor 147: | 50 kohm |

With the components of Table 1, invertor 120 oscillates at a frequency of approximately 60 kHz. With an input DC power source voltage of approximately 4.5 to 20 volts, the circuit operates at an efficiency of approximately 78 percent with approximately 1400 volts peak-to-peak appearing across the secondary of the transformer. When operating with an input DC power source voltage of approximately 3 to 5 volts, the efficiency increases to approximately 82 percent.

Figure 3:
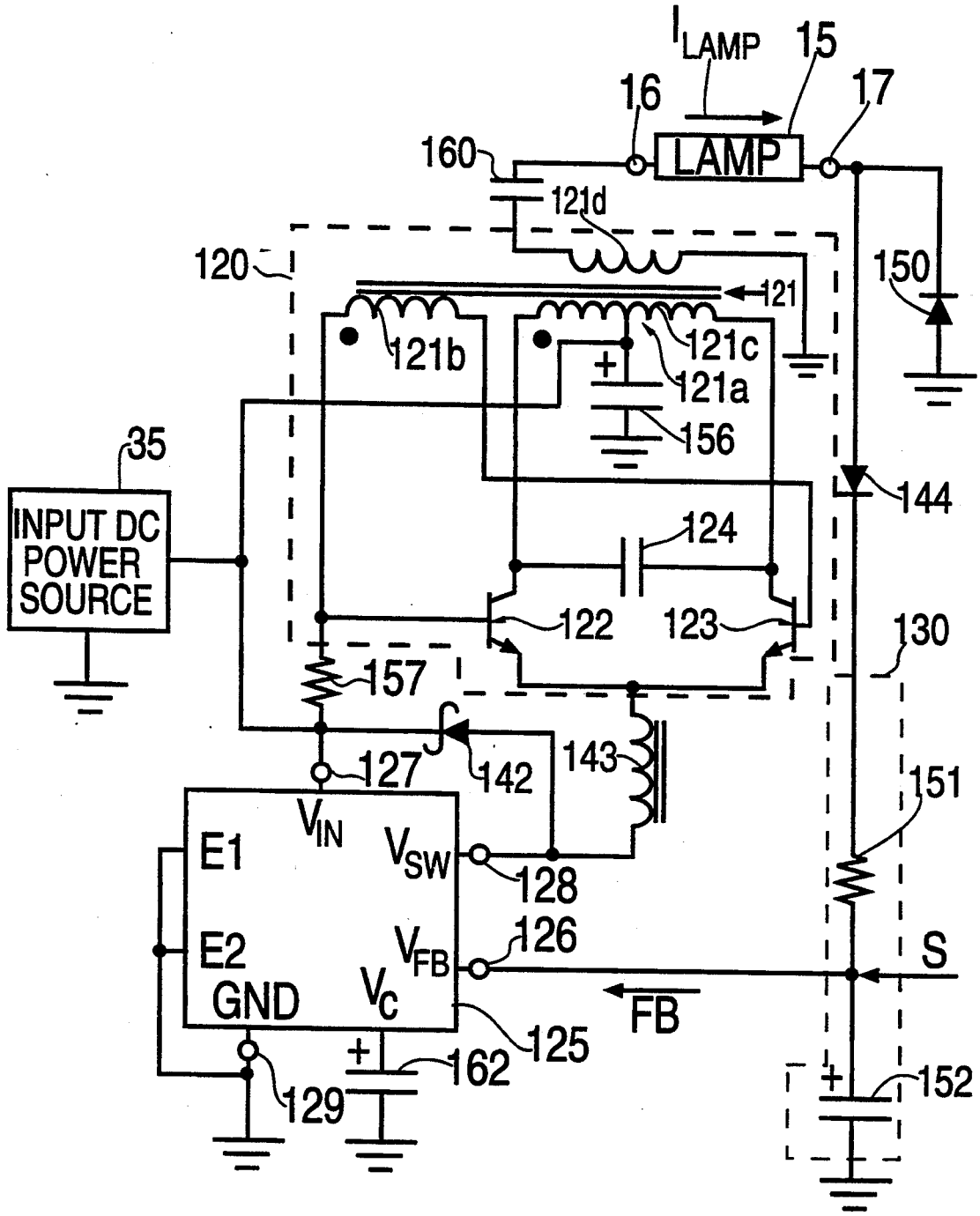
FIG. 3 is a schematic diagram of a second exemplary embodiment of the fluorescent lamp power supply and control circuit of FIG. 1.

It will be appreciated by those skilled in the art that the circuit of FIG. 2 could be modified in numerous ways without departing from the spirit and scope of the invention. For example, the intensity of lamp 15 could be varied other than by variable resistor 147 by variably introducing a signal S into the feedback loop as shown in FIG. 3. Signal S operates to vary the loop gain of the feedback loop by varying the magnitude of feedback signal FB applied to regulator 125. Just as with variable resistor 147 in FIG. 2, the introduction of signal S in FIG. 3 enables the intensity of lamp 15, to be varied without "dead-spots" or "pop-on."

For example, signal S in FIG. 3 could be taken from the output of a conventional photocell or other optical detector circuit (not shown) which monitors the intensity of ambient light. Such a circuit would enable the fluorescent lamp power supply and control circuit to compensate and adjust the fluorescent lamp intensity in response to the intensity of ambient light within the environment. Thus, when the intensity of the environmental ambient light is low, the fluorescent lamp's intensity could be regulated to a high value. Similarly, when the intensity of the environmental ambient light is high, the fluorescent lamp's intensity could be regulated to a low value. It will be appreciated by those skilled in the art, of course, that signal S could come from virtually any other circuit to cause the intensity of the fluorescent lamp to vary in some desired manner.

Figure 4A:
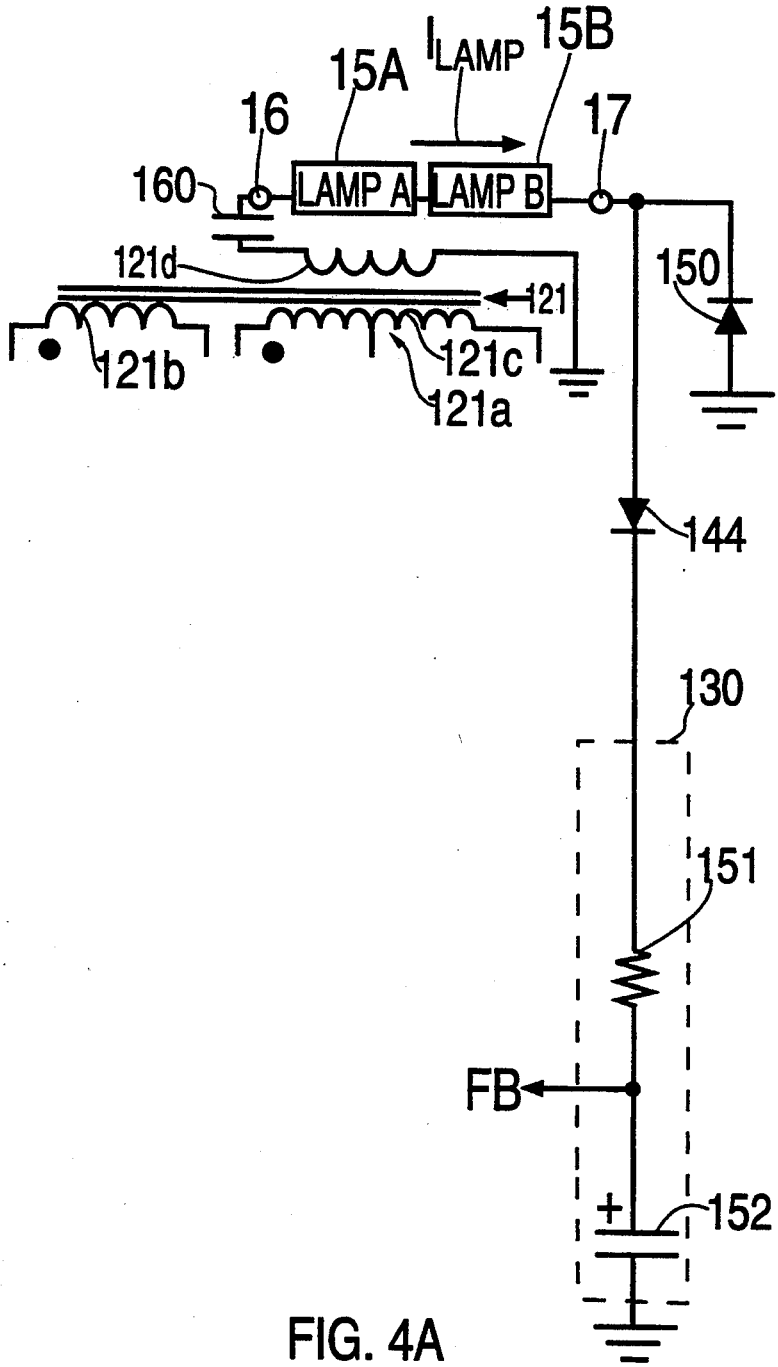
FIGS. 4A–4C are schematic diagrams showing various exemplary configurations for driving a plurality of fluorescent lamps in accordance with the principles of the present invention.
Figure 4B:
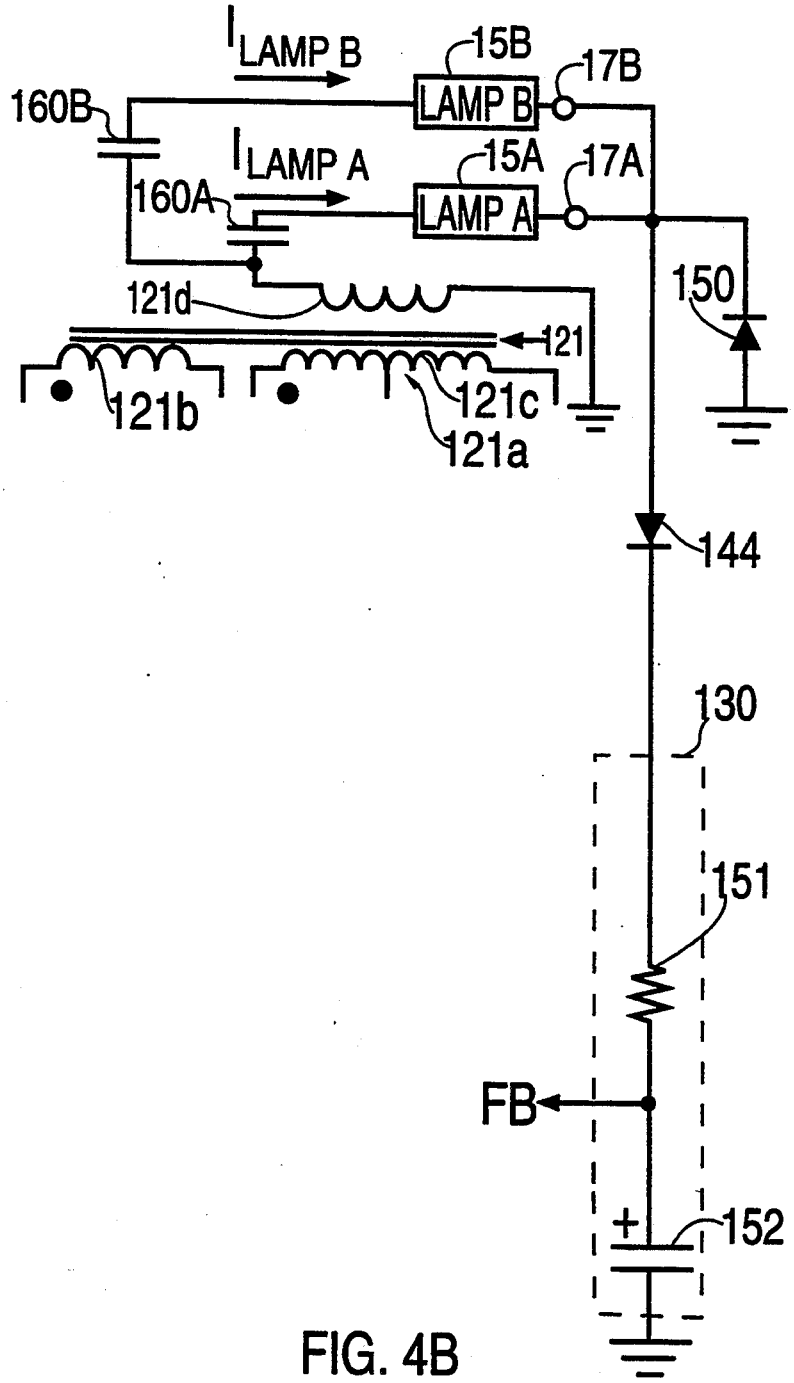
Figure 4C:
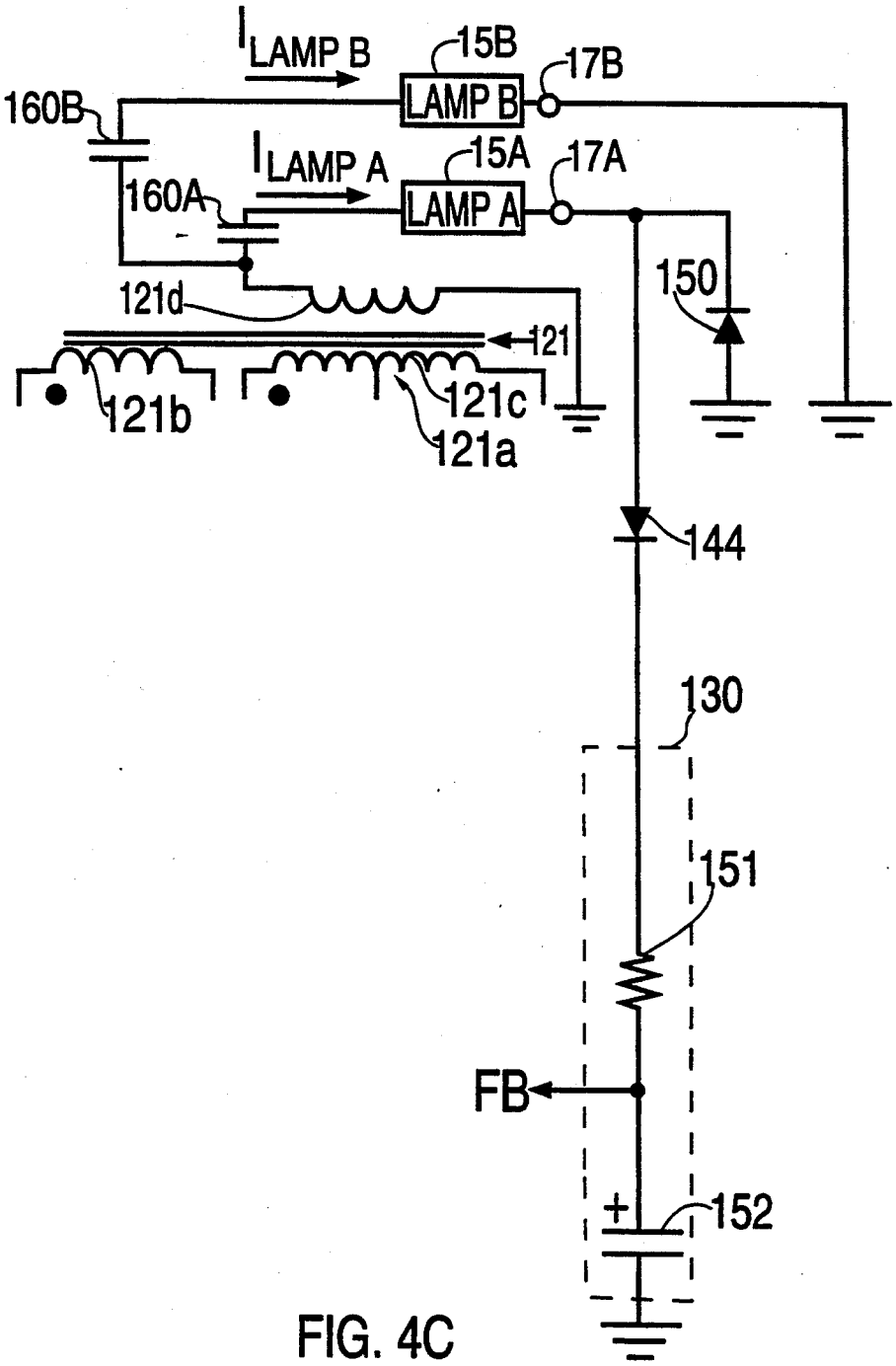

Further modifications, also within the scope of the invention, are shown in FIGS. 4A–4C, which show various exemplary circuit configurations for driving a plurality of fluorescent lamps. In the circuit of FIG. 4A, two fluorescent lamps 15A and 15B are driven in series between ballast capacitor 160 and terminal 17. Feedback circuit 130 is coupled in a fashion similar to that shown in FIG. 3 so as to sample lamp current $I_{LAMP}$ and provide current regulation.

In the circuit of FIG. 4B, two fluorescent lamps 15A and 15B, each with their own series-connected ballast capacitors 160A and 160B, respectively, are driven in parallel. Terminals 17A and 17B of lamps 15A and 15B, respectively are coupled together. Feedback circuit 130 is coupled commonly to terminals 17A and 17B of lamps 15A and 15B, respectively, and thus samples the combined lamp current $I_{LAMP} + I_{LAMPB}$ so as to provide current regulation. Furthermore, although ballast capacitors 160A and 160B are shown in FIG. 4B coupled commonly to secondary winding 121*d*, they could also be coupled to separate windings on the secondary side of transformer 121. Thus, transformer 121 could include a plurality of secondary windings with each lamp respectively coupled to the different windings through its respective ballast capacitor.

In the circuit of FIG. 4C, two fluorescent lamps 15A and 15B, each with their own series-connected ballast capacitors 160A and 160B, respectively, are driven under similar drive conditions (i.e., pseudo-parallel). However, feedback circuit 130 is coupled only to lamp 15A (via terminal 17A) so that only lamp current $I_{LAMPA}$ through lamp 15A is sampled to provide feedback. Although lamp 15B is not included within the feedback loop, its intensity will also be regulated to a substantially constant value if the operating characteristics of lamp 15B are similar to those of lamp 15A. Furthermore, although ballast capacitors 60A and 160B are shown in FIG. 4C coupled commonly to secondary winding 121*d*, they could also be coupled to separate windings on the secondary side of transformer 121. Thus, transformer 121 could include a plurality of secondary windings with each lamp respectively coupled to the different windings through its respective ballast capacitor.

Persons of ordinary skill in the art will recognize that the power supply and control circuit of the present invention could be implemented using circuit configurations other than those shown and discussed above. All such modifications are within the scope of the present invention, which is limited only by the claims which follow.

What is claimed is:

1. A circuit for operating a fluorescent lamp from a source of DC power, the circuit comprising:

a switching regulator circuit having an input adapted to be coupled to the DC power source, an output, and a control terminal adapted for receiving a feedback signal to control the output;

an inductive storage element coupled to the output of the switching regulator for producing a drive current;

a DC-to-AC inverter adapted for being driven by the drive current for producing an AC voltage sufficient to cause a current to be conducted through the fluorescent lamp so that the lamp emits light; and a circuit for sensing a current indicative of the current conducted by the fluorescent lamp, for generating a feedback signal indicative of the magnitude of the lamp current, and for coupling the feedback signal to the control terminal of the regulator to control the drive current to regulate the current conducted and the intensity of light emitted by the lamp; wherein:

the drive current has a primarily inductive impedance at the frequency of oscillation of the AC voltage.

2. The circuit of claim 1, further including a circuit for adjusting the feedback signal to responsively adjust the current conducted by the fluorescent lamp, whereby the intensity of light emitted by the fluorescent lamp can be smoothly and continuously varied over a range of intensities.

3. The circuit of claim 1, further including a circuit for adjusting the feedback signal to responsively adjust the current conducted by the fluorescent lamp, whereby the intensity of light emitted by the fluorescent lamp can be smoothly and continuously varied from substantially full OFF to full ON.

4. The circuit of claim 1, wherein the AC voltage produced by said DC-to-AC inverter is substantially sinusoidal.

5. The circuit of claim 1, wherein an output terminal of said DC-to-AC inverter is adapted to be coupled to the fluorescent lamp through a ballast capacitor.

6. The circuit of claim 1, wherein said current sensing circuit produces a feedback signal that is proportional to the current conducted by the fluorescent lamp.

7. The circuit of claim 6, wherein said current sensing circuit includes an impedance adapted to be coupled in series with the fluorescent lamp, and said feedback signal comprises a voltage developed across at least a portion of said impedance.

8. The circuit of claim 7 further including a rectifying means adapted to be coupled in series between the fluorescent lamp and said current sensing circuit for rectifying the current conducted by the lamp so that said current sensing circuit senses rectified lamp current.

9. The circuit of claim 2, wherein said current sensing circuit includes a first impedance adapted to be coupled in series with the fluorescent lamp and said feedback signal comprises a voltage developed across at least a portion of said first impedance, and wherein said feedback signal adjusting means comprises a variable impedance coupled in parallel with at least a portion of said first impedance, said variable impedance having a range of adjustment sufficient to vary the intensity of the fluorescent lamp over a range including substantially full OFF to full ON.

10. The circuit of claim 1 wherein an output terminal of said DC-to-AC inverter is adapted to be coupled to generate a current through a plurality of fluorescent-lamps.

11. The circuit of claim 10 wherein said plurality of fluorescent lamps are coupled in series.

12. The circuit of claim 10 wherein said plurality of fluorescent lamps are coupled in parallel and said current sensing circuit is adapted to sense the combined currents conducted by the fluorescent lamps.

13. The circuit of claim 10 wherein the fluorescent lamps are driven under substantially similar drive conditions and said current sensing circuit,is adapted to sense the current conducted by at least one and less than all of the fluorescent lamps.

14. A circuit for operating a fluorescent lamp from a source of DC power, the circuit comprising:

a switching regulator having an input adapted to be coupled to the DC power source, an output, and a control terminal adapted for receiving a feedback signal to control the output;

an inductive storage element coupled to the output of the switching regulator for producing a drive current:

a DC-to-AC inverter adapted for being driven by the drive current for producing an AC voltage sufficient to cause a current to be conducted through the fluorescent lamp so that the lamp emits light; and means for generating a feedback signal indicative of the magnitude of the current conducted by the lamp current, and for coupling the feedback signal to the control terminal of the switching regulator to regulate the current conducted and intensity of light emitted by the lamp; wherein:

the drive current has a primarily inductive impedance at the frequency of oscillation Of the AC voltage.

15. The circuit of claim 14 further comprising means for adjusting the feedback signal to responsively adjust the current conducted by the fluorescent lamp, whereby the intensity of light emitted by the fluorescent lamp can be smoothly and continuously varied over a range of intensities.

16. The circuit of claim 14 further comprising means for adjusting the feedback signal to responsively adjust the current conducted by the fluorescent lamp, whereby the intensity of light emitted by the fluorescent lamp can be smoothly and continuously varied from substantially full OFF to full ON.

17. The circuit of claim 14, wherein the AC voltage produced by said DC-to-AC inverter is substantially sinusoidal.

18. The circuit of claim 14, wherein the output terminal of said DC-to-AC inverter is adapted to be coupled to the fluorescent lamp through a ballast capacitor.

19. The circuit of claim 14, wherein said means produces a feedback signal that is proportional to the current conducted by the fluorescent lamp.

20. The circuit of claim 19, wherein said means includes an impedance adapted to be coupled in series with the fluorescent lamp, and said feedback signal comprises a voltage developed across at least a portion of said impedance.

21. The circuit of claim 20 further including a rectifying means adapted to be coupled in series between the fluorescent lamp and said means, for rectifying the current conducted by the lamp so that said means senses rectified lamp current.

22. The circuit of claim 15, wherein said means includes a first impedance coupled in series with the fluorescent lamp and said feedback signal comprises a voltage developed across at least a portion of said first impedance, and wherein said feedback signal adjusting means comprises a variable impedance coupled in parallel with at least a portion of said first impedance, said variable impedance having a range of adjustment sufficient to vary the intensity of the fluorescent lamp over a range including substantially full OFF to full ON.

23. The circuit of claim 14 wherein the output terminal of said DC-to-AC inverter is adapted to be coupled to generate a current through a plurality of fluorescent lamps.

24. The circuit of claim 23 wherein said plurality of fluorescent lamps are coupled in series.

25. The circuit of claim 23 wherein said plurality of fluorescent lamps are coupled in parallel and said means is adapted to sense the combined currents conducted by the fluorescent lamps.

26. The circuit of claim 23 wherein the fluorescent lamps are driven under similar drive conditions and said means is adapted to sense the current conducted by at least one and less than all of the fluorescent lamps.

27. A circuit for operating a fluorescent lamp from a source of DC power, the circuit comprising:

a current-mode switching regulator circuit having an input adapted to be coupled to the source of DC power, an output, an inductor coupled to the output for producing a drive current at the output, and a control terminal adapted for receiving a signal to control the drive current produced at the output;

an oscillator coupled to the output of said switching regulator circuit, said oscillator adapted for being driven by the drive current for producing an AC voltage;

a step-up transformer having a primary winding, and a secondary winding adapted to be coupled to the fluorescent lamp to generate a current through the fluorescent lamp, the primary winding being coupled to said oscillator to transform the voltage produced by said oscillator to a high AC voltage across the secondary winding sufficient to operate the fluorescent lamp; and a current sensing circuit including an impedance adapted to conduct a current indicative of at least a portion of the current conducted by the fluorescent lamp to generate a feedback signal proportional to that current, said current sensing circuit being coupled to conduct the feedback signal to the control terminal of the switching regulator to control the drive current to regulate the current conducted and the intensity of light emitted by the fluorescent lamp; wherein:

the drive current has a primarily inductive impedance at the frequency of oscillation of the AC voltage.

28. The circuit of claim 27, further including:

means for varying the feedback signal to responsively vary the current conducted by the fluorescent lamp, whereby the intensity of the fluorescent lamp can be smoothly and continuously controlled over a range of intensities.

29. The circuit of claim 27, further including:

means for varying the feedback signal to responsively vary the current conducted by the fluorescent lamp, whereby the intensity of the fluorescent lamp can be smoothly and continuously controlled from substantially full OFF to full ON.

30. The circuit of claim 27, wherein said current sensing circuit further includes:

a rectifier for rectifying the current conducted by the fluorescent lamp;

a resistance coupled in series with said rectifier; and a capacitance coupled in series with said resistance for filtering the rectified lamp current; and wherein:

the feedback signal comprises a voltage developed across said capacitance.

31. The circuit of claim 30, further including:

a variable resistance coupled to said current sensing circuit to vary the magnitude of the feedback signal and to responsively vary the current conducted by the fluorescent lamp, whereby the intensity of the fluorescent lamp can be smoothly and continuously adjusted.

32. The circuit of claim 27 wherein the secondary winding of said step-up transformer is adapted to be coupled to a plurality of fluorescent lamps.

33. The circuit of claim 32 wherein said plurality of fluorescent lamps are coupled in series.

34. The circuit of claim 32 wherein said plurality of fluorescent lamps are coupled in parallel and said current sensing circuit is adapted to sense the combined currents conducted by the fluorescent lamps.

35. The circuit of claim 32 wherein the fluorescent lamps are driven under similar drive conditions and said current sensing circuit is adapted to sense the current conducted by at least one and less than all of the fluorescent lamps.

36. A circuit operable from a source of DC power, the circuit comprising:

a fluorescent lamp;

a switching regulator control circuit having an input adapted to be coupled to the DC power source, an output, and a control terminal adapted for receiving a feedback signal to control the output;

an inductive storage element coupled to the output of the switching regulator control circuit for generating a controlled drive current;

a DC-to-AC inverter adapted for being driven by the drive current for producing an AC voltage sufficient to cause a current to be conducted through the fluorescent lamp so that the lamp emits light; and a circuit for sensing a current indicative of the current conducted by the fluorescent lamp, for responsively generating a feedback signal indicative of the magnitude of the lamp current, and for coupling the feedback signal to the control terminal of the regulator control circuit to control the drive current to regulate the current conducted and the intensity of the light emitted by the lamp; wherein:

the drive current has a primarily inductive impedance at the frequency of oscillation of the AC voltage.

37. A circuit operable from a source of DC power, the circuit comprising:

a fluorescent lamp;

a switching regulator having an input adapted to be coupled to the DC power source, an output, and a control terminal adapted for receiving a feedback signal to regulate the output;

an inductive storage element coupled to the output of the switching regulator for generating a drive current;

a DC-to-AC inverter adapted for being driven by the drive current for producing an AC voltage sufficient to cause a current to be conducted through the fluorescent lamp so that the lamp emits light; and a circuit for sensing a current indicative of the current conducted by the fluorescent lamp, for generating a feedback signal indicative of the magnitude of the lamp current, and for coupling the feedback signal to the control terminal of the switching regulator to regulate the current conducted and the intensity of light emitted by the lamp; wherein:

the drive current has a primarily inductive impedance at the frequency of oscillation of the AC voltage.

38. A circuit operable from a source of DC power, the circuit comprising:

at least one fluorescent lamp;

a current-mode switching regulator having an input adapted to be coupled to the source of DC power, an output, and a control terminal adapted for receiving a signal to control the output;

an inductor coupled to the output of the switching regulator for producing a drive current;

an oscillator driven by the drive current, said oscillator producing an AC voltage;

a step-up transformer having a secondary winding coupled to the fluorescent lamp, and a primary winding coupled to said oscillator to transform the AC voltage produced by said oscillator to a high AC voltage across the secondary winding sufficient to operate the fluorescent lamp; and a ballast capacitor;

wherein the secondary winding of said transformer, said ballast capacitor and the fluorescent lamp are coupled serially in a loop, and wherein the circuit further comprises:

a current sensing circuit including an impedance coupled to conduct a current indicative of at least a portion of the current conducted by the fluorescent lamp to generate a feedback signal proportional to that current, said current sensing circuit further being coupled to conduct the feedback signal to the control terminal of the switching regulator to regulate the current conducted and the intensity of light emitted by the lamp; wherein:

the drive current has a primarily inductive impedance at the frequency of oscillation of the AC voltage.

39. A method for operating a fluorescent lamp from a source of DC power, the method comprising the steps of:

driving an inductive storage element with a switching regulator to generate a drive current;

converting the DC power into an AC voltage in response to the drive current, wherein the AC voltage is sufficient to generate a current through the fluorescent lamp to cause the fluorescent lamp to cause the fluorescent lamp to emit light;

sensing a current indicative of the current conducted by the fluorescent lamp;

generating a feedback signal indicative of the magnitude of the lamp current; and coupling the feedback signal to a control terminal of the switching regulator to control the drive current in response to the feedback signal so that the current conducted and the intensity of light emitted by the lamp are regulated; wherein;

the drive current has a primarily inductive impedance at the frequency of oscillation of the AC voltage.

40. The method of claim 39, further including the step of adjusting the feedback signal to responsively adjust the current conducted by the fluorescent lamp, whereby the intensity of light emitted by the fluorescent lamp can be smoothly and continuously varied over a range of intensities.

41. The method of claim 39, further including the step of adjusting the feedback signal to responsively adjust the current conducted by the fluorescent lamp, whereby the intensity of light emitted by the fluorescent lamp can be smoothly and continuously varied from substantially full OFF to full ON.

42. The method of claim 39, wherein said converting step converts the DC power into substantially sinusoidal high-voltage AC.

43. The method of claim 39, wherein the feedback signal is proportional to the current conducted by the fluorescent lamp.

44. A circuit for operating a fluorescent lamp, the circuit comprising:

a switching regulator circuit having an output, the output being controlled by a feedback signal coupled to a control terminal of the regulator circuit;

an inductive storage element coupled to the output of the switching regulator circuit for producing a drive current;

a DC-to-AC inverter adapted for being driven by the drive current, coupled to the output, for producing an AC voltage sufficient for causing the fluorescent lamp to emit light in response to a current passing through the lamp;

a circuit for producing the feedback signal indicative of the magnitude of current conducted by the lamp, and for coupling the feedback signal to the control terminal of the regulator circuit to control the drive current to regulate the current conducted by the lamp; wherein:

the drive current has a primarily inductive impedance at the frequency of oscillation of the AC voltage.

* * * * *